US006792782B2

(12) United States Patent
Gouiran

(10) Patent No.: US 6,792,782 B2
(45) Date of Patent: Sep. 21, 2004

(54) METHOD FOR DEFORMING A TUBE NEAR ONE OF ITS ENDS AND TOOL USED IN THIS METHOD

(75) Inventor: Didier Gouiran, Ville-la-Grand (FR)

(73) Assignee: Parker Hannifin SA, Annemasse (FR)

( * ) Notice: Subject to any disclaimer, the term of this patent is extended or adjusted under 35 U.S.C. 154(b) by 0 days.

(21) Appl. No.: 10/423,968

(22) Filed: Apr. 28, 2003

(65) Prior Publication Data

US 2003/0192358 A1 Oct. 16, 2003

Related U.S. Application Data

(63) Continuation of application No. 09/869,915, filed as application No. PCT/FR00/03232 on Nov. 21, 2000, now abandoned.

(30) Foreign Application Priority Data

Nov. 30, 1999 (FR) ..... 99 15111

(51) Int. Cl.[7] ..... B21D 3/02

(52) U.S. Cl. ..... 72/115; 72/112; 72/125; 72/370.03; 72/370.1; 72/370.11

(58) Field of Search ..... 72/112, 115, 117, 72/125, 126, 370.01, 370.02, 370.03, 370.1, 370.11, 370.12, 370.13

(56) References Cited

U.S. PATENT DOCUMENTS 2,924,263 A * 2/1960 Landis ..... 72/117
3,451,243 A 6/1969 Gallinger
4,751,836 A * 6/1988 Breese ..... 72/62
4,871,199 A 10/1989 Ridenour et al.
4,905,492 A 3/1990 Lobakk
5,131,145 A 7/1992 Badoureaux
5,372,028 A * 12/1994 Brilman et al. ..... 72/117
5,622,071 A 4/1997 Van Riper et al.
5,810,054 A 9/1998 Goulet et al.
5,956,987 A 9/1999 Anthoine
6,327,771 B1 12/2001 Anglin et al.

FOREIGN PATENT DOCUMENTS

DE 295 21 617 U1 11/1997

* cited by examiner

*Primary Examiner*—Ed Tolan
(74) *Attorney, Agent, or Firm*—Oliff & Berridge, PLC

(57) ABSTRACT

The invention concerns a method using steps of placing a tube in an opening matrix having an impression corresponding to the desired final external shape; inserting the end of the tube into a cavity of a shaping component, the cavity having a base, a side wall with adapted shape, and an opening opposite the base; pressing the end of the tube against the base of the cavity, leaving a clearance between the opening of the cavity and the matrix; applying an essentially axial force on the end of the tube, the zone application of the force rotating about a longitudinal axis of the tube thereby causing gradual deformation of the tube; withdrawing the end of the deformed tube outside the cavity of the shaping component and outside the matrix.

18 Claims, 5 Drawing Sheets

METHOD FOR DEFORMING A TUBE NEAR ONE OF ITS ENDS AND TOOL USED IN THIS METHOD

This is a Continuation of application Ser. No. 09/869,915 filed Jul. 23, 2001, now abandoned which in turn is a U.S. National Stage of PCT/FR00/03232 filed Nov. 21, 2000, which claims the benefit of foreign priority FR 99.15111 filed Nov. 30, 1999. The entire disclosure of the prior applications is hereby incorporated by reference herein in its entirety.

The present invention relates to a method for deforming a tube near one of its ends, particularly for producing a sealed coupling for rigid tubes. The invention also relates to a tool used in such a method.

Figure 2:
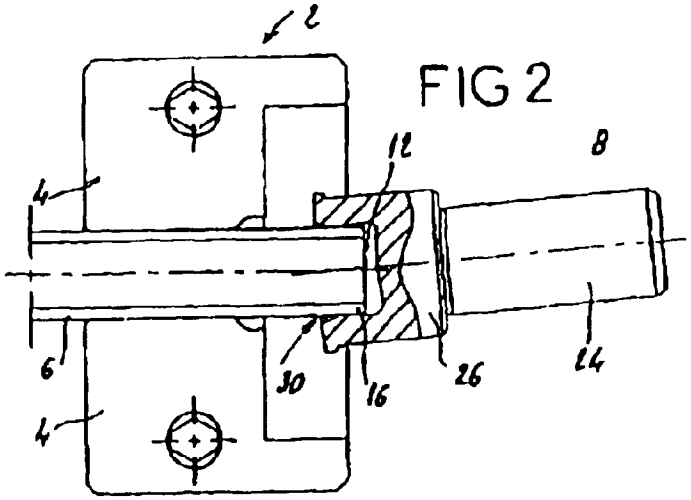

The method at issue here needs to make it possible to deform a tube in order to produce a coupling of the type depicted in FIG. 2 of document DE-195 26 316 C2 or alternatively in document DE-197 57 946 A1. These two documents disclose a coupling of a rigid pipe. A nut is pressed on to the tube that is to be coupled. The end of the tube to be coupled is introduced into a male part of the coupling which, on the one hand, on its exterior surface, has a screw thread corresponding to the tapping of the nut and, on the other hand, on its inside, has a conical bore. The tube is deformed outward to produce a shoulder that makes it possible to limit the length over which the tube to be coupled can be introduced into the male part. Once the end of the tube has been pushed into the male part, the nut is screwed on to the corresponding screw thread, bearing directly or indirectly on the deformation of the rigid tube that is to be coupled.

The cited documents do not indicate how the tube is deformed. It is in fact known practice for the end of the tube to be deformed to be placed in a die and for pressure to be exerted on the free end of the tube so as to deform its wall and for the material of which this tube is formed to be pushed into a housing provided for that purpose in the die.

One disadvantage of this device is that it entails the use of heavy duty machinery capable of exerting significant forces. Furthermore, it requires a great deal of energy to deform the tube.

Another disadvantage of this production method is that it breaks the fibers of the metal forming the tube that is to be coupled. In the region of the deformation, this tube is therefore weakened.

With other types of coupling, for which the deformation of the tube is performed immediately at the end of the tube that is to be coupled, it is known practice for the tube to be deformed by heading. Patent EP-0 381 603 B1 describes such a method for making a coupling. This method makes it possible to respect the fibers of the metal and consumes less energy but does not make it possible to produce a coupling such as those disclosed in document DE-197 57 946 A1.

An object of the present invention is therefore to provide a method which allows a tube to be deformed some distance from its free end without weakening it.

To this end, the invention proposes a method for deforming a tube having a longitudinal axis, near its end, in which method the tube is placed in an openable die having an impression corresponding to the desired final exterior shape, a free end of the tube protruding from the die.

According to the invention, this method further comprises the following steps:

introducing the end of the tube that protrudes from the die into a cavity of a form piece, this cavity having an end wall, a side wall of a shape tailored to the tube and to the desired deformation, and an opening opposite the end wall, pressing the end of the tube against the end wall of the cavity, some clearance remaining between the opening of the cavity and the die, applying an essentially axial force to the end of the tube via the form piece, the area of application of the force rotating about the longitudinal axis of the tube thus causing the tube to be deformed gradually, withdrawing the end of the deformed tube from the cavity of the form piece and from the die.

The fact that the force that allows deformation to be achieved is not applied simultaneously to the entire periphery of the tube allows the tube to be deformed gradually without breaking the fibers of the metal of which this tube is made. As the tube is introduced into a cavity, the deformation is controlled. By tailoring the shape of this cavity, it is possible to leave part of the tube undeformed over a predetermined length measured from its free end.

There are various conceivable ways of exerting a force locally on the tube by rotating about the axis thereof. For example, it is conceivable to have a press roller acting on one wall of the form piece piece [sic] by rolling along this wall and describing a circle about the axis of the tube that is to be deformed.

In one advantageous embodiment of the method according to the invention, the form piece is, for example, built into a tool having a longitudinal axis that is inclined with respect to the axis of the tube and more or less secant therewith, and the essentially axial force is exerted on the end of the tube by rotating the tool, the latter then being given an orbital movement with respect to the axis of the tube, and by simultaneously bringing the tool and the die closer together.

In this embodiment, the angle of inclination between the axis of revolution of the cavity and the axis of the tube is between 2 and 5 degrees.

It is also possible to envision that a die bar, intended to rest against the interior wall of the tube to be deformed is introduced into the latter when the end of the tube is introduced into the cavity of the tool. The inside of the tube is then shaped at the same time as this tube is deformed.

In another embodiment of a method according to the invention, the form piece is placed on the end of the tube in such a way that the longitudinal axis of the cavity more or less corresponds to the longitudinal axis of the tube, and an external tool presses against an opposite face of the form piece to the face in which the cavity is made.

In this case, the external tool is advantageously a tool with an axis inclined with respect to the longitudinal axis of the tube, and this tool is given an orbital movement with respect to the longitudinal axis of the tube, combined with a movement of translation toward the die.

The present invention also relates to a tool for implementing a deforming method according to the invention. This tool it is in the form of a more or less cylindrical component, at the end of which is made an open cavity having an axis of revolution and having an end wall arranged more or less in a transverse plane and a conical region near the end wall and narrowing in the direction away from this wall. The cavity has, for example, at its open end, a second conical region connecting to the first and widening toward the open end.

To produce an annular bulge or a rib on the exterior surface of the tube that is to be deformed, the cavity advantageously has an annular groove. Likewise, to produce an annular groove on the exterior surface of the tube that is to be deformed, the cavity advantageously has an annular rib.

Another type of tool that can be used to implement a method according to the invention comprises a more or less cylindrical component, at the end of which is made an open cavity having an axis of revolution and having an end wall arranged more or less in a transverse plane and a conical region near the end wall, and it also comprises a die bar mounted to pivot with respect to a transverse axis of the cavity. This die bar allows the tube to be shaped from the inside during deformation.

In one advantageous embodiment of this type of tool, the cavity is made in a tubular piece into which the die bar fits, the end wall of the cavity being formed by the base of the die bar, these two parts being mounted in a housing of more or less circular cylindrical shape, having an end wall and open at the opposite end.

In any event, the invention will be well understood with the aid of the description which follows, with reference to the appended schematic drawing which, by way of nonlimiting examples depict a number of alternative forms of embodiment of a method according to the invention and a number of tools used in these alternative forms.

Figure 4:
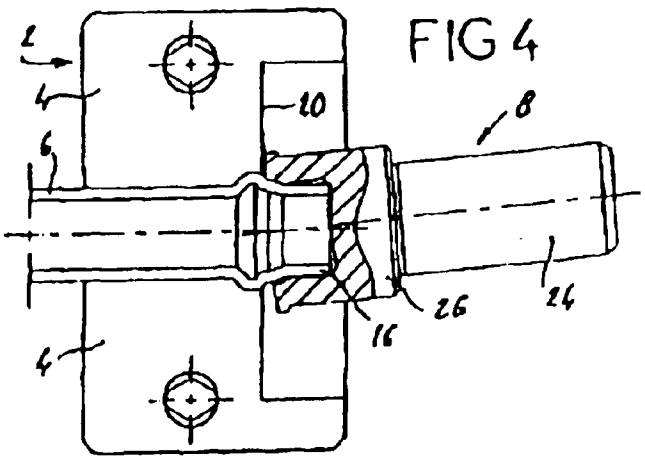
Figure 5:
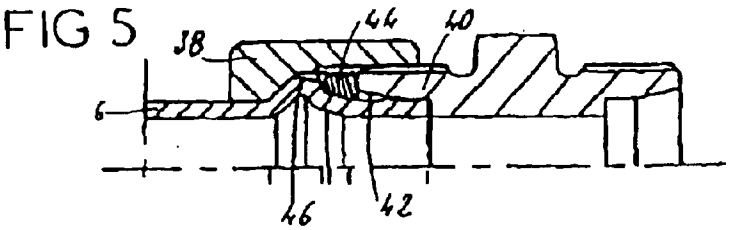
Figure 6:
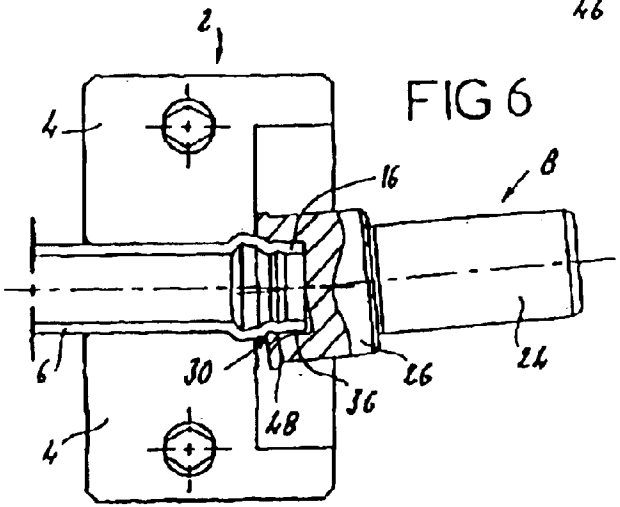
Figure 8:
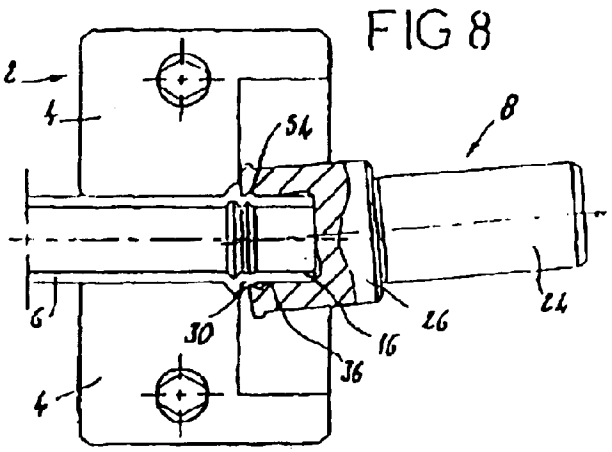
Figure 7:
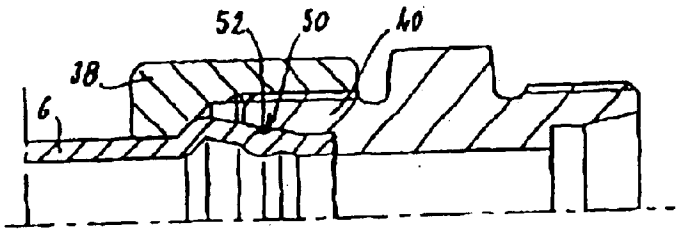
Figure 9:
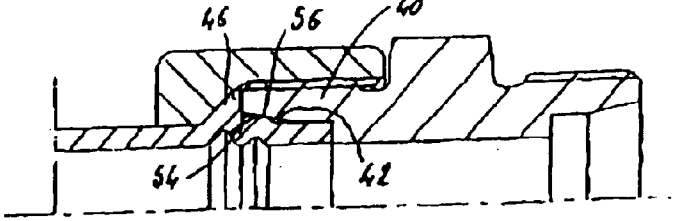
Figure 14:
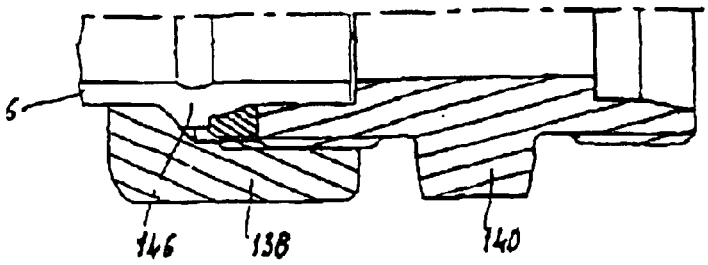
Figure 15:
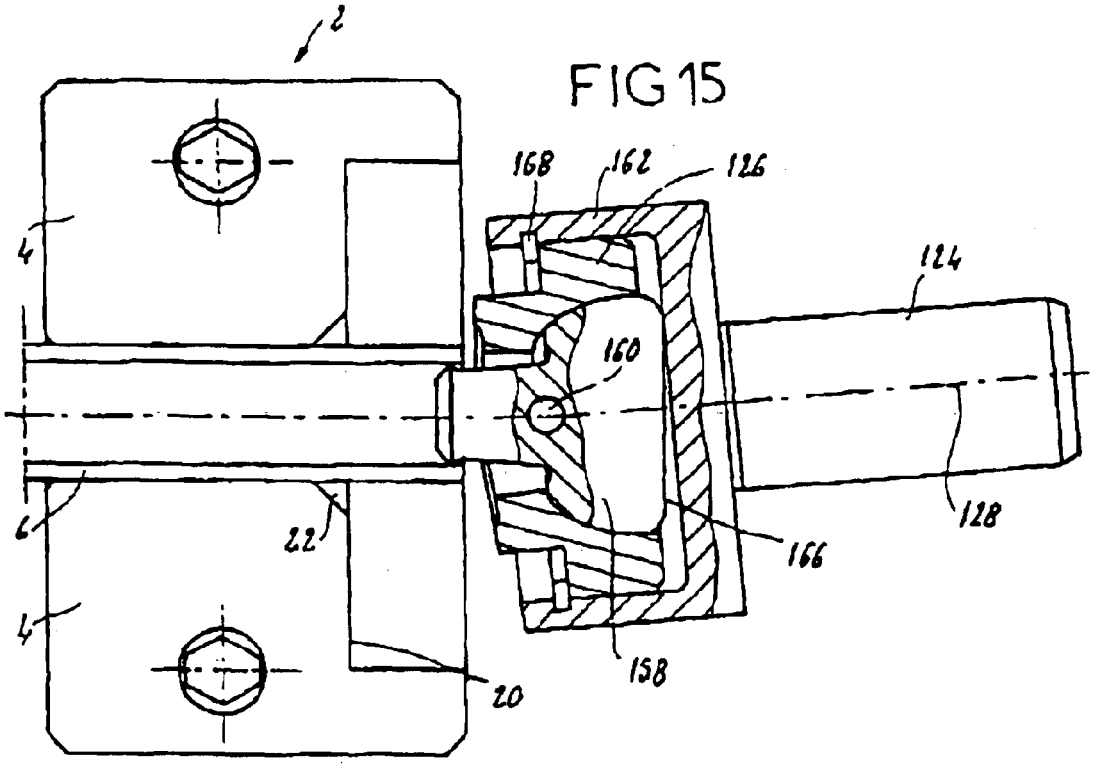

FIGS. 1 to 4 schematically depict four steps in a method for deforming a tube near one of its ends, FIG. 5 is a view in section showing a coupling obtained from the deformation illustrated in FIGS. 1 to 4, FIG. 6 is a view corresponding to FIG. 4 for an identical method using a different tool, FIG. 7 is a view in section showing a coupling using a tube as depicted deformed in FIG. 6, FIG. 8 is a view corresponding to FIG. 4 for another alternative form of embodiment, FIG. 9 is a view in section of a coupling obtained with a tube as depicted in FIG. 8, FIGS. 10 to 13 are views showing an alternative form of a method according to the invention, FIG. 14 is a view in section showing a coupling obtained with a tube deformed by the method illustrated in FIGS. 10 to 13, FIG. 15 shows, on a larger scale, an alternative form of embodiment of the tool depicted in FIGS. 10 to 13, and FIG. 16 is a view corresponding to FIG. 15 for another alternative form of embodiment of a tool according to the invention.

FIGS. 1 to 4 depict an openable die 2 with two jaws 4. Between these two jaws a tube 6 can be fitted. This tube is arranged in such a way that a free end thereof projects from the die 2. These figures also show a tool 8 having a front face 10 in which a cavity 12 is made.

The tube 6 is a circular cylindrical metal tube. It has a longitudinal axis of symmetry 14.

The die 2 is intended to hold the tube 6 while it is being deformed and also partly determines the shape of the deformed tube. The two jaws 4 that form the die 2 are pressed together by means which are not depicted and are known to those skilled in the art. Thus, they clamp and hold the tube 6 in place. A free end 16 of the tube 6 projects from the die 2. The tube 6 will be deformed in the region where the tube 6 emerges from the die 2.

The jaws 4 have a recess 18 corresponding more or less to the exterior surface of the tube to be deformed. The dimensions of this recess 18 are tailored to allow excellent clamping of the tube 6. At the face 20 of the die from which the free end 16 of the tube projects, an additional groove 22 is made in each jaw 4. The shape of this groove 22 is tailored to the deformation that is to be produced.

The tool 8 comprises a spindle 24, to the end of which a form piece 26 is fixed. The cavity 12 is made in the form piece 26. The spindle 24 and the form piece 26 are two parts with a more or less circular cylindrical exterior envelope each having a common axis of revolution 28. This axis 28 is secant with the axis 14 of the tube and is inclined with respect to the latter by about 4°.

The cavity 12 has an opening 30 at the front face 10. Opposite the opening 30, the cavity 12 has an end wall 32 which is more or less transverse with respect to the axis 28. At the same end as the end wall 32, the cavity 12 has a frustoconical surface 34. The cone frustum narrows toward the opening 30. Before this opening 30, the area of the cavity 12 widens again. The cavity 12 therefore has a narrowing 36. This widening of the cavity 12 at the same end as the opening 30 is in the form of two frustoconical regions with different cone angles.

Figure 1:
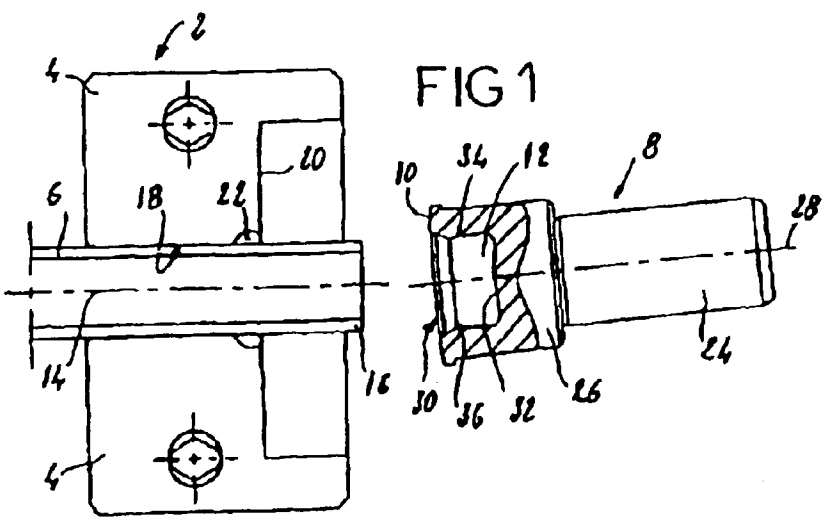
Figure 3:
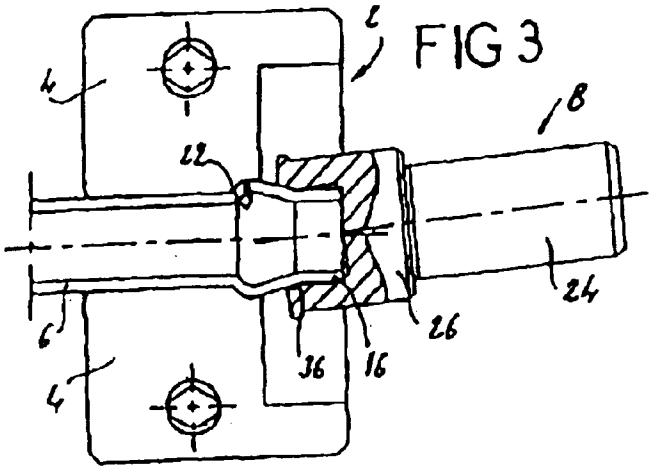

FIG. 1 shows only the various objects used to implement a method according to the invention. In FIG. 2, as can easily be seen, a relative movement between the tool and the die has taken place. It is assumed here that the die 2 is stationary while the tool 8 can move in translation in a direction parallel to the axis 14 of the tube 6. Thus, the tool 8 is brought up close to the die 2 and the free end 16 of the tube 6 enters the cavity 12 of the form piece 26. The tool 8 is then rotated about the axis 14 of the tube. This tool is then given an orbital movement with respect to the tube 6. The axis 28 of the tool is then made to describe a cone about the axis 16 of the tube 2. This rotational movement is combined with the translational movement in the direction given by the axis 14 of the tube 6. The tool holder for driving the tool 8 is not depicted in the drawing. Such a tool holder is known to those skilled in the art. Use may here be made of a heading machine of the same type as the one described in document FR-2 660 219.

As the tool 8 is moved closer to the die 2, the free end 16 of the tube comes into abutment against the end wall 32 of the cavity 12. The depth of the cavity 12 and the length of the tube projecting from the die are such that when the end 16 of the tube comes into abutment against the end wall 32 of the cavity, there is still a space between the front face 10 of the tool and the face 20 of the die. The tool continues to be driven in its orbital movement and in its translational movement to cause the tube 6 to deform. By virtue of the combination of these two movements, the tool 8 exerts on the tube 6, particularly on its free end 16, a more or less axial force. This force is not exerted on the entire periphery of the tube but is exerted locally. The region of application of this force rotates with the tool 8. There is therefore a force which moves around the periphery of the tube. This makes it possible to perform "gentle" deformation which is not rough with the material of which the tube is made and does not break the fibers of the metal.

The frustoconical zone 34 of the cavity 12 is such that as the tool 8 rotates, the free end 16 of the tube 6 is not deformed. Deformation of the tube 6 begins at the narrowing 36 of the cavity. The tool 8 pushes back the material of the tube 6 into the groove 22 made in the jaws 4. At the same time, the part of the cavity that lies between the narrowing 36 and the opening 30 shapes the outside of the tube to give it the desired shape. As depicted in FIG. 4, the tool 8 butts against the face 20 of the die 2. Deformation of the tube is complete. The free end 16 of the tube is then withdrawn from the cavity 12 and the jaws 4 are opened. The tube is thus released.

FIG. 5 shows a coupling produced with the tube deformed by virtue of the method illustrated in FIGS. 1 to 4. Within this coupling can be recognized the deformed tube 6, a nut 38, a threaded nipple 40 having a conical interior surface 42, and a seal 44. These various parts are known to those skilled in the art and are standardized. They will therefore not be described in detail here. The outer bulge 46 obtained by upsetting the tube into the groove 22 of the jaws 4 acts as a shoulder at the end of the nut 38. The region shaped from the outside by the form piece 26 acts as a support for the seal 44. The latter bears against the front face of the nipple 40.

FIG. 6 shows an alternative form of the tool 8. Thus, it is possible to deform the tube 6 differently. Here, in the region of the cavity lying between the opening 30 and the narrowing 36, the cavity has an annular rib 48 which is intended to produce a groove 50 on the exterior surface of the tube 6. This groove 50 is intended to take an O-ring seal 52. The method of deforming the tube is identical to the one described earlier. The drawing therefore depicts only a step of this method which corresponds to the step shown in FIG. 4.

Likewise, FIG. 8 depicts a step in the deforming method corresponding to the step depicted in FIG. 4. Here, the region of the cavity lying between the narrowing 36 and the opening 30 has an annular groove 54. This groove 54 makes it possible to produce a second bulge 56 on the exterior surface of the tube. As depicted in FIG. 9, there are therefore the first bulge 46 and the second bulge 56. The second bulge 56 is located in the region of the conical surface 42 of the nipple 40. The O-ring seal 52 is placed between the two bulges 46 and 56. Here then, sealing is achieved at the conical surface 42.

FIGS. 10 to 13 illustrate an alternative form of the deforming method described with reference to FIGS. 1 to 4. As can be seen in these figures, the tool used here is very much different than the tools depicted in FIGS. 1 to 4, 6 and 8. In principle, there is again a form piece 126 in which a cavity 112 is formed. However, at the center of the cavity 112 there is a die bar 158 mounted to pivot about a transverse axis 160. The form piece 126 and the die bar 158 are mounted in a housing formed in a support 162. This support is itself mounted on a spindle 124. The spindle 124 and the support 162 have a common axis of revolution 128. On the die 2 side, there are the same elements again. The only difference to be noted in FIGS. 10 to 13 as regards the die concerns the groove 22 which has a slightly different shape. As with the method described earlier, the axis 14 of the tube 6 is secant with the axis 128 of the tool and the angle formed between the axis 14 and the axis 128 is about 4°.

The deforming method is as follows.

Figure 10:
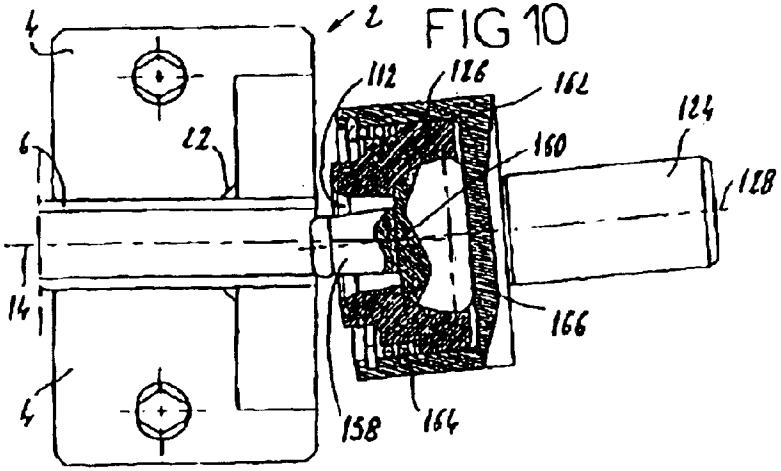

During a first step depicted in FIG. 10, the tool is moved closer to the die 2. It therefore has a translational movement in the direction given by the axis 14 of the tube 6. During this approach movement, the tool can also be given an orbital movement as described hereinabove. The axis 128 of the tool therefore describes a cone about the axis 14 of the tube. As can be seen in FIG. 10, the die bar presses against the interior wall of the tube 6. The edge of the tip of this die bar is rounded so as to make it easier to introduce into the tube 6. As the approach movement continues, the die bar 158 pivots about its axis 160 and enters the tube 6. The area of contact between the form piece 126 and the base of the die bar 158 is more or less spherical. A spring 164 holds the form piece in place on the die bar.

Figure 11:
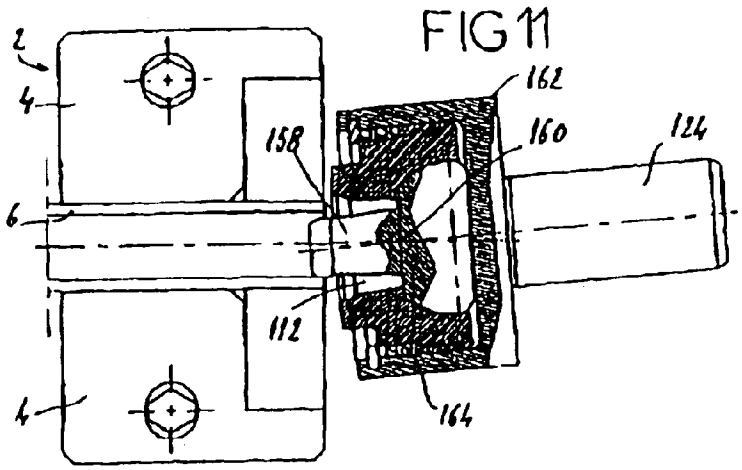
Figure 13:
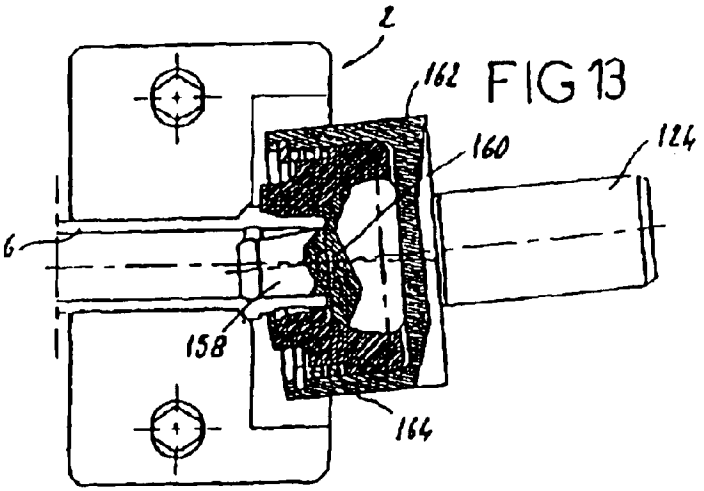
Figure 12:
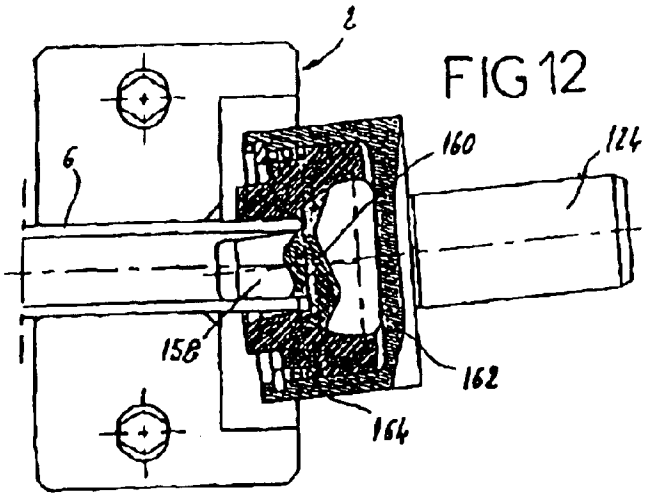

Once the die bar has been introduced into the tube 6 as shown in FIG. 11, the approach movement of the tool approaching the die continues, a wall of the tube 6 then comes into abutment against the end wall of the cavity 112. Here, the end wall of the cavity 112 is formed by the base of the die bar 158. This is depicted in FIG. 12. The approach movement of the tool combined with its orbital movement continues. There is then, as explained earlier, a more or less axial force applied to the free end of the tube. This force is exerted locally, the region of application rotating at the periphery of the tube. However, here, in addition to deformation via the outer wall, there is shaping of the interior of the tube using the die bar. Thus, it is possible perfectly to control the thickness of the tube in the deformed region.

Once the deformation has been achieved, the tool moves away from the die and the jaws 4 of the latter are opened so as to release the deformed tube. This tube is then used to produce, for example, a coupling as depicted in FIG. 14. Here we find a nut 138 engaging with a threaded nipple 140. Of course, the nut 138 is mounted on the tube 6 before the latter is deformed. In this coupling, it may be noted that the tube 6 also has a bulge 146 against which the end of the nut 138 bears. In the region of this bulge 146, it may be noted that the tube has an increased thickness which it has been possible to achieve using the die bar 158.

FIG. 5 shows in greater detail and on a larger scale an alternative form of the embodiment of a tool that can be used in the method illustrated in FIGS. 10 to 13. Here again there is a form piece 126 and a die bar 158. These two parts are housed in a support piece 162. The latter is mounted at the end of a spindle 124. In the rest position, this assembly has an axis of revolution 128.

The die bar has a domed base with a flat bottom 166. The support piece 162 is pot-shaped. The flat bottom 166 of the die bar rests against the interior end wall of the support piece 162. The base of the die bar 158 has a frustoconical projection extending along the axis 128 (when the assembly is in the rest position). At its end, this frustoconical projection has an annular rib, the shape of which is tailored to the desired shaping of the inside of the tube 6. Thus the transition between the base of the die bar and the frustoconical projection is the axis 160 of articulation of the die bar. This axis is transversal with respect to the axis 128 of the tool.

The form piece 126 here is a tubular piece. It covers the die bar 158 in the manner of a ring. At the base of the die bar, the form piece 126 is in contact. The contact surface is a more or less spherical surface. This surface allows the die bar to pivot without causing the form piece 126 to pivot. At the frustoconical projection of the die bar, there is a clearance remaining between the die bar and the form piece. This clearance is intended to allow the passage of the wall of the tube 6 that is to be deformed. The exterior surface of the form piece 126 is more or less circular cylindrical. It matches the interior wall of the support piece 162 which is pot-shaped. An elastic ring 168 holds the assembly formed by the die bar 158 and the ring 126 in the support piece 162.

Figure 16:
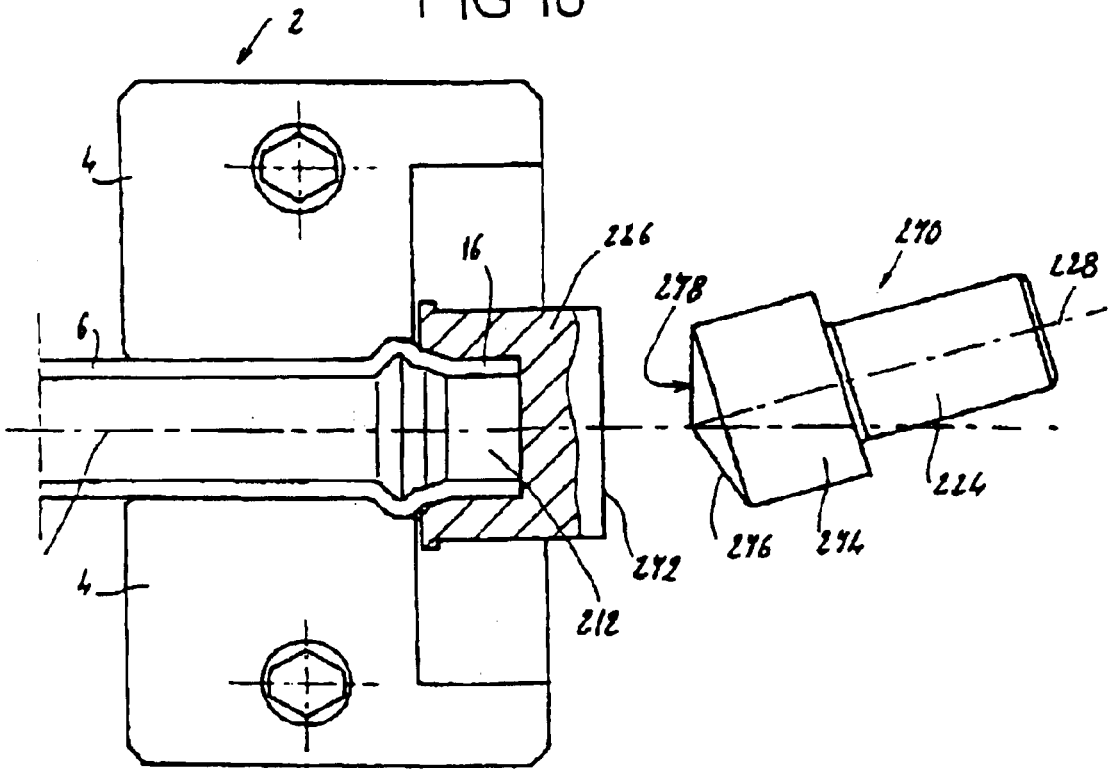

FIG. 16 shows an alternative form of a tool which can be used to produce deformation of the tube 6 near its free end 16. Here, the die 2 remains unchanged. It has two jaws 4, a face 20 from which the tube 6 to be deformed projects, and a housing to accommodate the tube. Grooves 22 are also provided, to allow the wall of the tube to be deformed.

Here, the tool is made in two separate parts: a form socket 226 and an inclined flat die bar 270.

The form piece 126 has the form of a socket closed at one of its ends. This form piece therefore has a cavity 212. This cavity is of a shape tailored to the tube and to the desired deformation of the tube. The form piece 226 has an axis of revolution. When the form piece is in place on the free end 16 of the tube 6 this axis of revolution is coincident with the axis 14 of the tube. On the opposite side to the face on which the cavity 212 opens, the form piece has a transverse flat end wall 272.

The inclined flat die bar comprises a spindle 224 of axis 228. This axis 228 is secant with the axis 14 of the tube and is inclined with respect to this axis. Mounted at the end of the spindle 224 is a die bar head 274 having a flats and conical front face 276. The cone angle is such that the front face exhibits a ridge 278 perpendicular to the axis 14 of the tube.

To deform the tube, the form piece 226 is set in place on the free end of the tube 6. This form piece may be connected to the die 2. This connection allows translational displacement of the form piece 226 along the axis 14. The free end of the tube 16 rests against the end wall of the cavity 212 of the form piece 226. The inclined flat die bar is given an orbital movement. Its axis 228 therefore describes a cone about the axis 14. This die bar 270 is also given a translational movement in the direction given by the axis 14 toward the die 2. The die bar 270 presses via its front face 276 against the end wall 272 of the form piece 226. During this movement, there is always a ridge 278 in contact with the end wall 272 of the form piece 226. This line of contact rotates about the axis 14. The die bar 270 exerts a more or less axial force on the form piece 226. This force is wholly passed on to the tube 16. It is localized at the angular position of the ridge 278 which is in contact with the end wall 272. During the orbital movement of the die bar 270, the force-application region moves around the periphery of the free end of the tube. Once the desired deformation has been achieved, the die bar and the form piece 226 are withdrawn and the deformed tube is released by opening the die 2.

All the methods described hereinabove make it possible to deform a tube near its free end. These methods are economical methods because the energy used to deform a tube is less than the energy used by the methods of the prior art which allow such deformation to be achieved. In addition, these methods make it possible for a metal tube to be deformed without breaking the fibers of the metal. As a result of this, in the region of the deformation, the tube exhibits no weakness. The robustness and rigidity of the tube remain constant along its entire length.

As goes without saying, the invention is not restricted to the methods described hereinabove by way of nonlimiting examples, or to the tools described also by way of nonlimiting examples; on the contrary, it encompasses all the alternative versions that fall within the context of the claims which follow.

What is claimed is:

1. A method for deforming a tube having a longitudinal axis, near its end is placed in an openable die with an impression corresponding, to the desired final exterior shape, and a free end of the tube protruding from the die, said method comprising:

introducing the end of the tube that protrudes from the die into a cavity of a form piece, the cavity having an end wall, a side wall of a shape tailored to the tube and to the desired deformation, and an opening opposite the end wall;

pressing the end of the tube against the end wall of the cavity such that some clearance remains between the opening of the cavity and the die;

applying an essentially axial force to the end of the tube via the form piece, the force being exerted locally on a periphery of the tube and its area of application rotating about the longitudinal axis of the tube, thereby causing the tube to be deformed gradually; and withdrawing the end of the deformed tube from the cavity of the form piece and from the die.

2. The deforming method according to claim 1, wherein the form piece is built into a tool having a longitudinal axis that is inclined with respect to the axis of the tube and more or less secant therewith, and in that the essentially axial force is exerted on the end of the tube by rotating the tool, the latter then being given an orbital movement with respect to the axis of the tube, and by simultaneously bringing the tool and the die closer together.

3. The tool for implementing the deforming method according to claim 2, wherein the form piece is of a more or less cylindrical component, at the end of which is made an open cavity having an axis of revolution and having an end wall arranged more or less in a transverse plane and conical region near the end wall and narrowing in the direction away from the wall.

4. The deforming method according to claim 2, wherein an angle of inclination between an axis of revolution of the cavity and the axis of the tube is between 2 and 5 degrees.

5. The tool for implementing the deforming method according to claim 4, wherein the form piece is of a more or less cylindrical component, at the end of which is made an open cavity having an axis of revolution and having an end wall arranged more or less in a transverse plane and conical region near the end wall and narrowing in the direction away from the wall.

6. The deforming method according to claim 4, further comprising a die bar which is intended to rest against the interior wall of the tube to be deformed is introduced into the latter when the end of the tube is introduced into the cavity of the tool.

7. The deforming method according to claim 2, further comprising a die bar which is intended to rest against the interior wall of the tube to be deformed is introduced into the latter when the end of the tube is introduced into the cavity of the tool.

8. The tool for implementing the deforming method according to claim 7, wherein the form piece is of a more or less cylindrical component, at the end of which is made an open cavity having an axis of revolution and having an end wall arranged more or less in a transverse plane and a conical region near the end wall, and in that it also comprises a die bar mounted to pivot with respect to a transverse axis of the cavity.

9. The tool for implementing the deforming method according to claim 8, wherein the cavity is made in a tubular piece into which the die bar fits, the end wall of the cavity being formed by the base of the die bar, these two parts being mounted in a housing of more or less circular cylindrical shape, having an end wall and open at the opposite end.

10. The deforming method according to claim 1, wherein the form piece is placed on the end of the tube in such a way that the longitudinal axis of the cavity more or less corresponds to the longitudinal axis of the tube, and in that an external tool presses against an opposite face of the form piece to the face in which the cavity is made.

11. The deforming method according to claim 10, wherein the external tool is a tool with an axis inclined with respect to the longitudinal axis of the tube, and in that the tool is given an orbital movement with respect to the longitudinal axis of the tube, combined with a movement of translation toward the die.

12. The tool for implementing a deforming method according to claim 1, wherein the form piece is of a more or less cylindrical component, at the end of which is made an open cavity having an axis of revolution and having an end wall arranged more or less in a transverse plane and a conical region near the end wall and narrowing in the direction away from the wall.

13. The tool for implementing the deforming method according to claim 12, wherein the cavity has, at its open end, a second conical region connecting to the first and widening toward the open end.

14. The tool for implementing the deforming method according to claim 13, wherein the cavity has an annular groove.

15. The tool for implementing the deforming method according to claim 13, wherein the cavity has an annular rib.

16. The tool for implementing the deforming method according to claim 12, wherein the cavity has an annular groove.

17. The tool for implementing the deforming method according to claim 16, wherein the cavity has an annular rib.

18. The tool for implementing the deforming method according to claim 12, wherein the cavity has an annular rib.

* * * * *